United States Patent [19]

Stoneking

[11] 4,076,487

[45] Feb. 28, 1978

[54] IGNITION AND CONTROL SYSTEM FOR GAS BURNING APPARATUS

[75] Inventor: Richard D. Stoneking, Corunna, Ind.

[73] Assignee: Essex Group, Inc., Fort Wayne, Ind.

[21] Appl. No.: 754,490

[22] Filed: Dec. 27, 1976

[51] Int. Cl.[2] ..... F23N 5/24

[52] U.S. Cl. ..... 431/25; 431/46

[58] Field of Search ..... 431/24, 25, 26, 46

[56] References Cited

U.S. PATENT DOCUMENTS

| | | | |
|---|---|---|---|
| 3,082,814 | 3/1963 | Pinckaers | 431/46 |
| 3,376,099 | 4/1968 | Giuffrida et al. | 431/46 |
| 3,482,922 | 12/1969 | Blackett | 431/26 |

*Primary Examiner*—Carroll B. Dority, Jr.
*Attorney, Agent, or Firm*—Robert D. Sommer; Lawrence E. Freiburger

[57] ABSTRACT

A fail-safe, self-checking ignition and control system for a gas burning apparatus having a pilot burner which is initially ignited by electric ignition means upon a need for operation of the apparatus and which in turn ignites a main burner after a flame is established at the pilot burner, the gas flow to the pilot burner being through a first valve and the gas flow to the main burner being through a second valve receiving its gas supply from the first valve. Energization of the ignition means and the two valves is controlled by circuit means of the system including a time delay device, two relays, and solid state flame detecting means. Each time the system is initially energized upon a need for operation of the gas burning apparatus, it tests the critical components of the system and acts to prevent operation of the apparatus if the failure of any such critical component is detected. In the absence of such a failure, the ignition and control system effects energization of the first valve and the ignition means and, subsequently, upon the establishment of a flame at the pilot burner, effects energization of the second valve. If the gas issuing from the pilot burner fails to ignite within a predetermined time period after initial energization of the first valve, the time delay device terminates the energization of the first valve.

5 Claims, 1 Drawing Figure

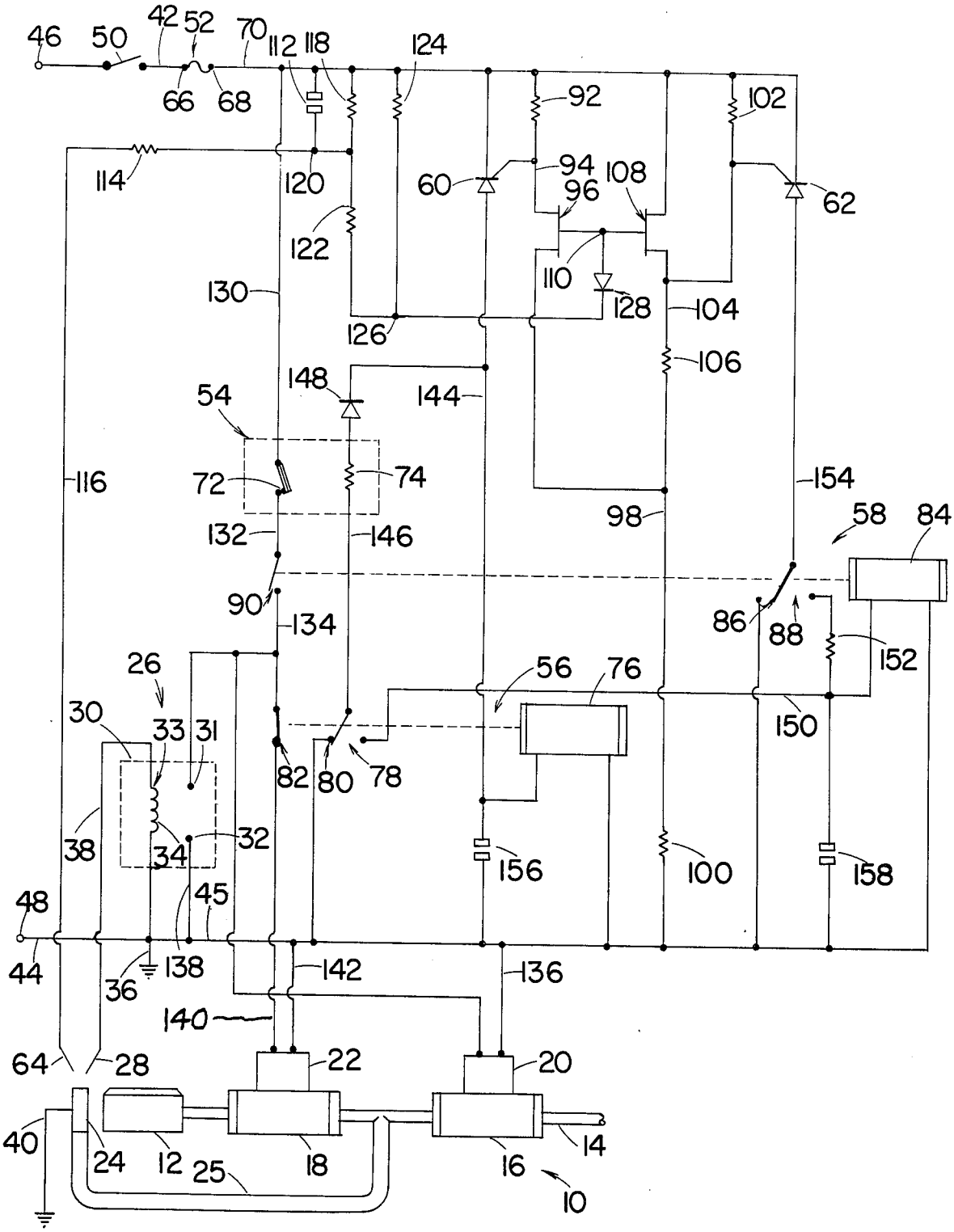
46
50
42
52
70
112
118
124
66
68
92
102
114
120
60
94
96
108
62
122
110
128
130
126
104
106
148
144
54
116
72
74
154
98
58
84
132
146
90
134
86
88
152
26
56
76
30
33
31
150
82
80
78
38
34
32
156
100
158
48
45
44
138
142
136
36
140
64
28
22
20
40
24
12
25
18
16
14
10

IGNITION AND CONTROL SYSTEM FOR GAS BURNING APPARATUS

BACKGROUND OF THE INVENTION

This invention relates to ignition and control systems for gas burning apparatus and more particularly to an improved ignition and control system for the reliable and safe operation of gas burning apparatus of the type in which a pilot flame is established each time operation of the gas burning apparatus is required for igniting gas supplied to a main burner.

In some types of gas burning apparatus, it has been a common practice to employ a continuously burning pilot flame for igniting the main burner. To obviate the need for such a gas-wasting operation of a pilot burner, various automatic ignition and control systems have been proposed for directly igniting the main burner of gas burning apparatus with electric ignition means whenever operation of the apparatus is required. Ignition and control systems of this type are the subject of many prior U.S. patents including the following;

U.S. Pat. No. 3,384,439, Walbridge — May 21, 1968
U.S. Pat. No. 3,610,789, Jones — Oct. 5, 1971
U.S. Pat. No. 3,610,790, Lindberg — Oct. 5, 1971
U.S. Pat. No. 3,619,097, Clay et al. — Nov. 9, 1971
U.S. Pat. No. 3,673,464, Lamb et al. — June 27, 1972
U.S. Pat. No. 3,758,260, Newport et al. — Sept. 11, 1973
U.S. Pat. No. 3,941,553, Bedford — Mar. 2, 1976

A problem encountered in use of such prior ignition and control systems with high rate gas burning apparatus was the dangerous accumulation of unburned gas in the combustion chamber in the event of failure of the ignition means to promptly ignite gas issuing from the main burner, even when the ignition trial period was limited to a short interval of time by a safety time delay device. To avoid this problem, still other automatic ignition and control systems have been proposed for first igniting a low energy pilot burner with electric ignition means whenever operation for the gas burning apparatus is required and subsequently supplying gas to a main burner for ignition by the pilot burner when the presence of flame at the pilot burner is sensed by flame detecting means. Ignition and control systems of the latter type are disclosed, for instance, by the following U.S. patents:

U.S. Pat. No. 2,981,324, Deziel — Apr. 25, 1961
U.S. Pat. No. 3,727,073, Cade — Apr. 10, 1973
U.S. Pat. No. 3,918,881, Matthews — Nov. 11, 1975

Many of these prior art ignition and control systems employ flame detecting means comprising a flame sensing electrode positioned adjacent a burner and connected to a solid state flame detector circuit in an attempt to obtain improved safety and reliability. Although some of these systems are designed to prevent unsafe operation of a gas burning apparatus upon a malfunction of certain components of the flame detecting means, none affords complete self-testing of all critical components of the system including the actuator means of the safety time delay device before any gas is allowed to flow. Such a self-checking function is important in preventing operation of a gas burning apparatus when the ignition and control system is incapable of functioning properly to protect against potentially dangerous conditions.

SUMMARY OF THE INVENTION

Therefore, it is the principal object of the present invention to provide an improved ignition and control system for gas burning apparatus incorporating a simple and reliable arrangement of elements which affords a complete self-testing of all critical components of the system prior to the supply of any gas to the burners of the apparatus upon each need for operation of the apparatus and which will place the gas burning apparatus in a fail-safe condition if any such failure is detected.

The present invention comprises an ignition and control system for a gas burning apparatus of the type in which the supply of gas to a pilot burner is through an electrically operated pilot or ignition valve, the supply of gas to a main burner is through the pilot valve and an electrically operated main valve downstream of the pilot valve, and an electrically operated ignition means is employed to ignite gas issuing from the pilot burner upon a need for operation of the apparatus to establish a pilot flame for subsequent ignition of gas issuing from the main burner. In accordance with the invention, electrical energy for energization of the system is applied to power supply conductors or terminals of the system through a thermostat or other suitable controller upon a need for operation of the gas burning apparatus by means including a circuit breaker responsive to the current flowing between the power supply conductors and opening to disrupt the current flow when the current exceeds a predetermined value. The ignition and control system further includes a normally closed time delay switch having electrical actuator means for opening the time delay switch when energized for a predetermined time interval, electrically operated first and second relays each adapted to be switched between a passive, non-operated state and an active, operated state, and a flame detecting means having first and second solid state switches which are triggered into conduction by circuit means including flame sensing means responsive to the presence or absence of flame at the pilot burner. The system also includes a first circuit comprising the time delay switch and a serially connected first switch closed by the second relay in its active state for energizing the pilot valve operator and the ignition means from the power supply conductors and further comprising a branch circuit connected in parallel with the pilot valve operator and including a second switch closed by the first relay in its passive state for energizing the main valve operator. The first relay includes first switch means employed for checking both the non-shorted and continuate conditions for the actuator means of the time delay device as well as for initially effecting energization of the coil of the second relay. The second relay includes second switch means employed to check that the second solid state switch initially has a non-conductive condition and to thereafter establish an alternate energization circuit for the coil of the second relay.

The self-checking operation of the ignition and control system commences immediately upon closing of the controller to apply an operating voltage to the power supply conductors and is completed before the coil of the second relay is energized to commence a trial ignition of the pilot burner. A second circuit for checking the non-shorted condition of the actuator means of the time delay switch includes the first switch means of the first relay in its passive state connecting the actuator means of the time delay switch in series with the first solid state switch to the power supply conductors to effect opening of the circuit breaker when the actuator means is shorted. A third circuit for checking that the second solid state switch is initially non-conductive includes the second switch means of the second relay in its passive state connecting the second solid state switch to the power supply conductors to effect opening of the circuit breaker when the second solid state switch is in a conductive or shorted condition. In the absence of any such malfunction, a fourth circuit connecting the first solid state switch and the coil of the first relay in series to the power supply conductors is effective to cause energization of the coil of the first relay. The resultant switching of the first relay from a passtive state to an active state completes a fifth circuit for checking the continuity of the actuator means of the time delay switch including the first switch means of the first relay in its active state connecting the first solid state switch, the actuator means of the time delay switch, and the coil of the second relay in series to the power supply conductors to effect energization of both the actuator means and the coil of the second relay when the actuator means has a continuate condition. Upon energization of its coil the second relay is switched from a passive state to an active state, causing its second switch means to establish a holding circuit for its coil which is subsequently completed when the second solid state switch is triggered into conduction.

At this time, the switching of the second relay to its active state causes energization of the pilot valve operator and the ignition means, and under normal conditions the gas issuing from the pilot burner is ignited within a short period of time. Upon establishment of the pilot burner flame, its presence is sensed by the flame sensing electrode to render the first solid state switch non-conductive and the second solid state switch conductive with the resulting deenergization of the coil of the first relay and the completion of the holding circuit for the coil of the second relay. With its coil deenergized, the first relay reverts to its passive state thereby causing completion of the branch circuit of the first circuit to energize the main valve operator. In the event the gas issuing from the pilot burner fails to ignite within a predetermined short interval of time following energization of the pilot valve operator, the continued energization of the actuator means of the time delay switch by the fifth circuit will result in opening of the time delay switch to interrupt the flow of gas to the pilot burner.

In a preferred embodiment of the invention, the first and second solid state switches are silicon controlled rectifiers having their respective gates connected to first and second gate control networks. The first gate control network includes a first field effect transistor operative when nonconductive to prevent triggering of the first silicon controlled rectifier and the second gate control network includes a second field effect transistor operative when conductive to prevent triggering of the second silicon controlled rectifier. The gates of the transistors have a common input circuit connected to the flame sensing electrode including a capacitor charged by rectified current flow through the flame at the pilot burner to effect a cut-off bias of the field effect transistors.

The invention will be more readily understood from the following detailed description of the preferred embodiment of the invention, taken in conjunction with the accompanying drawing wherein:

BRIEF DESCRIPTION OF THE DRAWING

The single FIGURE is a schematic diagram of a fail-safe, self-checking ignition and control system for a gas burning apparatus constructed in accordance with the present invention.

DETAILED DESCRIPTION OF THE PREFERRED EMBODIMENT

Referring now to the drawing, the improved ignition and control system of the present invention is schematically illustrated in connection with a portion of a conventional gas burning apparatus indicated generally at 10. The gas burning apparatus 10 has a main burner 12 which is supplied with gas from a suitable source (not shown) by a supply conduit 14. Gas flow control means comprising a biased closed, electrically operated pilot or ignition valve 16 and a biased closed, electrically operated main valve 18 are serially connected in the conduit 14 to control the flow of gas to the main burner 12. The valves 16 and 18 have respective electrical operators 20 and 22 such as solenoid windings which are each energized to open its respective valve. A pilot burner 24 disposed adjacent the main burner 12 is supplied with gas from the outlet of the pilot valve 16 through a supply pipe 25 connected to the conduit 14 at a location intermediate the pilot valve 16 and the main valve 18.

The gas burning apparatus 10 also includes electrically operated ignition means 26 shown as comprising an ignition electrode 28 positioned adjacent the pilot burner 24 and a spark voltage generator 30 including power input terminals 31 and 32 and a high voltage transformer with a secondary winding 34. The spark voltage generator 30 may be of any well-known type such as that disclosed in the Miller U.S. Pat. No. 3,400,302 issued Sept. 3, 1968.

One terminal of the secondary winding 34 is grounded at 36 and the other terminal is connected by a conductor 38 to the ignition electrode 28 so that the secondary winding 34 supplies a sparking voltage across the ignition electrode 28 and the pilot burner 24 which is grounded at 40 for igniting gas issuing from the pilot burner 24.

The spark voltage generator 30, the valve operators 20 and 22 and the various components comprising the ignition and control system of the present invention are supplied with alternating current voltage which may be on the order of 24 volts by a pair of conductors 42 and 44 respectively connected to input terminals 46 and 48 which in turn are adapted for connection to a suitable electrical power source (not shown). The input terminal 48 is connected directly to the conductor 44 which in turn is connected to a conductor 45 that may be grounded at 36. The input terminal 46 is connected to the conductor 42 by a normally open controller 50 such as a thermostatic switch which is closed upon a need for operation of the gas burning apparatus.

The supply of gas to the pilot burner 24 for ignition by the ignition means 26 and the supply of gas to the main burner 12 for ignition by the pilot burner 24 is controlled by the improved ignition and control system of the present invention in a safe and efficient manner which affords automatic testing of each critical component of the ignition and control system before any gas is allowed to issue from either burner. In the preferred embodiment of the invention schematically illustrated in the drawing, the ignition and control system comprises a current overload circuit breaker 52, a time delay device 54, a first flame relay 56, a second flame relay 58 and flame detecting means including two silicon controlled rectifiers (SCR's) or other equivalent solid state switching devices 60 and 62 and a flame sensing electrode 64 positioned adjacent the pilot burner 24.

The circuit breaker 52 may be a fuse as shown in the drawing or may be a conventional magnetic or thermal type circuit protector of the manual reset type which assumes an open circuit condition in response to an over-load current flow therethrough. One terminal 66 of the circuit breaker 52 is connected to the conductor 42 and the other terminal 68 is connected to a conductor 70. The circuit breaker 52 is thus responsive to the current flowing in the circuit paths extending between the conductors 70 and 45 and opens to disrupt such current flow when the current exceeds a predetermined normal value. The time delay device 54 may be a conventional safety timer with a normally closed switch 72 and actuator means including an electrical heater 74 operable when energized for a predetermined time interval on the order of 15 seconds to open the switch 72. The time delay device 54 may be of the type in which the opened switch 72 must be manually reset to a closed condition or may be of the type in which the opened switch 72 automatically recloses after deenergization of the heater 74 for a predetermined time period on the order of 30 seconds. The flame relay 56 has an actuator coil 76 which when energized closes a normally open relay switch 78 and opens normally closed relay switches 80 and 82. The flame relay 58 has an actuator coil 84 which when energized opens a normally closed relay switch 86 and closes normally open relay switches 88 and 90.

SCR 60 and SCR 62 of the flame detecting means have their respective anodes connected to the power supply conductor 70. SCR 60 is triggered into conduction by gating potentials or firing signals developed across a resistor 92 connected at one end to the conductor 70 and at the other end to the gate of SCR 60 by a conductor 94. The resistor is connected in a gate control network extending across the conductors 70 and 45 and comprising the resistor 92, the conductor 94, the source-drain path of a field effect transistor (FET) 96, a conductor 98, and a resistor 100. The FET 96 therefore is operative when non-conductive to block the supply of firing signals to SCR 60 and to consequently prevent triggering of SCR 60. SCR 62 is triggered into conduction by gating potentials or firing signals developed across a resistor 102 connected at one end to the conductor 70 and at the other end to the gate of SCR 62 by a conductor 104. The resistor 102 is connected in a gate control network extending across the conductors 70 and 45 and comprising the resistor 102, the conductor 104, a resistor 106, the conductor 98, and the resistor 100. The latter gate control network further includes a field effect transistor (FET) 108 having its source-drain path connected in parallel with the resistor 102 and operative when conductive to shunt firing signals from SCR 62 and to consequently prevent triggering of SCR 62.

FET 96 and FET 108 of the flame detecting means have their respective gates connected together at a junction 110 to a common gate input circuit or biasing network which includes a capacitor 112 and a resistor 114 connected in series between the conductors 70 and the flame sensing electrode 64. The flame sensing electrode is positioned to be enveloped in the flame at the pilot burner 24 such that the flame present at the pilot burner 24 provides a conductive path between the flame sensing electrode 64 and the pilot burner 24. The presence of flame at the pilot burner 24 thus completes an electric circuit which extends from the conductor 70 through the capacitor 112 and a resistor 114 connected in series between the conductors 70 and the flame sensing electrode 64. The flame sensing electrode is positioned to be enveloped in the flame at the pilot burner 24 such that the flame present at the pilot burner 24 provides a conductive path between the flame sensing electrode 64 and the pilot burner 24. The presence of flame at the pilot burner 24 thus completes an electric circuit which extends from the conductor 70 through the capacitor 112, the resistor 114, a conductor 116, the flame sensing electrode 64, the pilot burner 24, and the grounds 40 and 36 to the conductor 45. Due to flame rectification, the current flow through this circuit when a flame is present at the pilot burner 24 charges the capacitor during alternate half cycles of the voltage applied to the conductors 70 and 45. A resistor 118 connected between the conductor 70 and the junction 120 of the capacitor 112 and the resistor 114 together with two resistors 122 and 124 connected in series between the conductor 70 and the junction 120 function to discharge the capacitor 112 when the conductive path between the flame sensing electrode 64 and the pilot burner 24 is interrupted upon the pilot flame becoming extinguished. The junction 126 of the resistors 122 and 124 is connected by a diode 128, poled as shown, to the junction 110 for applying a portion of the voltage across the capacitor 112 as a cut-off bias voltage to the respective gates of FET 96 and FET 108 when flame is present at the pilot burner 24.

A normally open valve operator circuit comprising the conductors 130, 132, 134 and 136 connects the pilot valve operator 20 across the power supply conductors 70 and 45 in series with the time delay switch 72 and the normally open switch 90 of the flame relay 58. The input terminals 31 and 32 of the spark voltage generator 30 are connected in parallel with the pilot valve operator 20 in the valve operator circuit by the conductors 134 and 138 to effect energization of the spark voltage generator 30 whenever the valve operator 20 is energized. The main valve operator 22 is also connected in parallel with the pilot valve operator 20 in the valve operator circuit by a branch circuit comprising the conductors 134, 140 and 142 and the normally closed switch 82 of the flame relay 56.

SCR 60 and SCR 62 of the flame detecting means are connected in circuits energized from the power supply conductors 70 and 45 for testing and energizing various components of the ignition and control system upon a need for operation of the gas burning apparatus 10. The coil 76 of the flame relay 56 has one end connected to the conductor 45 and its other end connected by a conductor 144 to the cathode of SCR 60. The heater 74 of the time delay device 54 has one end connected by a conductor 146 to the conductor 45 through the normally closed switch 80 of the flame relay 56 and its other end connected to the cathode of SCR 60 by a diode 148, poled as shown, and the conductor 144. The coil 84 of the flame relay 58 is connected between the conductor 45 and the cathode of SCR 60 in series with the time delay heater 74 by the normally open switch 78 (when closed) of the flame relay 56, the diode 148 and the conductors 150, 146 and 144. The coil 84 of the flame relay 58 is also connected between the conductor 44 and the cathode of SCR 62 through a resistor 152 by the normally open switch 88 (when closed) of the flame relay 58 and the conductors 150 and 154. The resistor 152 may have a resistance value on the same order as that of the time delay heater 74 so that the respective voltages applied to the relay coil 84 by SCR 60 and SCR 62 have substantially the same values. Capacitors 156 and 158 are respectively connected in parallel with the relay coils 76 and 84 to ensure proper operation of the flame relays 56 and 58 with half wave rectified electrical current. The cathode of SCR 62 is connected to the conductor 45 by the normally closed switch 86 of the flame relay 58 and the conductors 154 and 160.

The ignition and control system of the present invention is shown in the drawing in a standby condition with the controller 50 open and all the components of the system therefore deenergized. Upon a need for operation of the gas burning apparatus 10, the controller is closed to apply an operating voltage to the voltage supply conductors 42 and 44, and thence through the circuit breaker 52 to the power supply conductors 70 and 45. At this time under normal conditions, FET 96 and FET 108 will both be conductive to respectively render SCR 60 conductive and SCR 62 non-conductive since the capacitor 112 is uncharged in the absence of flame at the pilot burner 24. Conduction by SCR 60 provides a conductive path between the conductors 70 and 45 energizing the coil 76 of the flame relay 56. Upon the relay coil 76 being energized, the flame relay 56 switches from its non-operated state to its operated state, thereby closing the relay switch 78 and opening the relay switches 80 and 82. The closing of relay switch 78 completes an energization circuit for the heater 74 of the time delay device 54 and the coil 84 of the flame relay extending from the conductor 70 through the anode-cathode path of SCR 60, the conductor 144, the diode 148, the heater 74, the conductor 146, the relay switch 78, the conductor 150 and the relay coil 84 to the conductor 45. Upon the relay coil 84 being energized, the flame relay 58 switches from its non-operated state to its operated state, thereby opening the relay switch 86 and closing the relay switches 88 and 90. The closing of flame relay switch 90 completes an energization circuit for the pilot valve operator 20 and the spark voltage generator 30 through the time delay switch 72 resulting in the opening of the pilot valve 16 and the application of a sparking voltage across the ignition electrode 28 and the pilot burner 24. The main valve 18, however, remains closed since the opening of the flame relay switch 82 interrupts the branch circuit connecting the main valve operator 22 in parallel with the pilot valve operator 20.

Under normal operating conditions, the gas issuing from the pilot burner 24 will be ignited in a very short period of time after opening of the pilot valve 16. When the flame sensing electrode is enveloped by the resulting pilot flame at the pilot burner 24, the conductive path between the electrode 64 and the burner 24 completes an electric circuit providing a flow of flame rectified current through the pilot flame and the resistor 114 to the capacitor 112. Within a fraction of a second following ignition of the pilot flame, the capacitor 112 is charged by the rectified current flow through the pilot flame to a voltage of a value such that the portion of this voltage developed across the resistor 124 is sufficient to effect a cut-off bias of FET 96 and FET 108. When FET 108 is thus biased to a nonconductive state, its source-drain path no longer shunts the resistor 102 and the current flow through the resistor 102 therefore develops firing signals which are applied to the gate of SCR 62 to trigger SCR 62 into conduction. Conduction of SCR 62 completes a circuit including the relay switch 88 and the resistor 152 for maintaining the coil 84 of the flame relay 58 energized independently of the initial energizing circuit provided by SCR 60. FET 96 upon being concurrently biased to a non-conductive state blocks the supply of firing signals to the gate of SCR 60 and consequently prevents triggering of SCR 60 into conduction. When SCR 60 is thus rendered non-conductive, the energizing circuit for the time delay heater 74 and the coil 84 of the flame relay 58 provided by SCR 60 is interrupted, the relay coil 84, however, being maintained energized by SCR 62. The coil 76 of the flame relay 56 is also energized upon SCR 60 being rendered non-conductive to open the relay switch 78 and close the relay switches 80 and 82. The closing of relay switch 82 completes the branch circuit connecting the main valve operator 22 in parallel with the pilot valve operator 20. The main valve 18 is thereupon opened upon energization of its operator 22 to supply gas to the main burner 12 where it is ignited by the pilot flame.

If, during start-up of the gas burning apparatus 10 following closing of the controller 50, the gas issuing from the pilot burner 24 fails to ignite within a predetermined short interval of time following opening of the pilot valve 16, the continued energization of the time delay heater 74 will result in opening of the time delay switch 72, thereby opening the energizing circuit for the pilot valve operator 20 to interrupt the flow of gas to the pilot burner 24. The time delay heater 74 will remain energized under these conditions as long as the controller 50 remains closed. Since the gas flow through the pilot burner 24 is at a low rate and continues only for a short interval of time following opening of the pilot valve 16 if not ignited, the accumulation of unburned gas in the gas burning apparatus 10 is minimal in the event of failure of the ignition means 26.

In the event of the flames at the pilot burner 24 and the main burner 12 becoming extinguished during normal operation of the gas burning apparatus 10, the gas issuing from the pilot burner 24 should be immediately ignited again by the ignition means 26. If, however, the flame at the pilot burner 24 is not immediately re-established, the interruption of charging current to the capacitor 112 resulting from the absence of a conductive path between the flame sensing electrode 64 and the pilot burner 24 allows the capacitor 112 to discharge through the resistors 118, 122 and 124. Upon such a continued discharge for a time interval on the order of 0.2 to 0.4 seconds, the voltage across the capacitor 112 decreases to a value insufficient to maintain FET 96 and FET 108 biased off or non-conductive. FET 96 and FET 108 thereupon become conductive to respectively render SCR 60 conductive and render SCR 62 non-conductive, whereupon the flame relay 58 switches to its non-operated state. At this time, the ignition and control system is restored to its initial start-up condition and will function in the manner previously described to either cause issuance of gas from the main burner 12 after establishment of a flame at the pilot burner 24 or cause opening of the time delay switch 72 if a flame is not established at the pilot burner 24 within a predetermined time interval.

If a failure of the electric power source occurs during normal operation of the gas burning apparatus 10, the pilot valve operator 20 and the main valve operator 22 as well as the flame relays 56 and 58 are deenergized. Deenergization of the valve operators 20 and 22 causes the respective valves 16 and 18 to close and within a short time the flames of both burners 12 and 24 become extinguished. Upon restoration of electric power to the input terminals 46 and 48, the main valve operator 22 will not be energized until a flame is again established at the pilot burner 24.

Upon each closing of the controller 50, the ignition and control system of this invention functions to detect the failure of any key component of the system itself and to prevent the supply of gas to the gas burners if any such failure is detected. This self-checking function is important in preventing operation of the gas burning apparatus 10 when the ignition and control system is incapable of functioning properly to protect against hazardous conditions which could cause an explosion. One critical component of the ignition and control system is the time delay device 54 since it is essential that gas be supplied to the pilot burner 24 for only a limited period of time if the ignition means 26 is inoperative to establish a pilot flame. Other critical components are the various components of the flame detecting means which upon failure would cause a false indication of flame at the pilot burner 24 since it is essential that gas be supplied to the main burner 12 only when a flame is present at the pilot burner 24.

The self-checking operating of the ignition and control system commences immediately upon closing of the controller 50 to apply an operating voltage to the voltage supply conductors 42 and 44. Since no flame is present at the pilot burner 24 at this time, SCR 60 normally will be conductive and SCR 62 normally will be non-conductive. In the event that SCR 62 has failed in a shorted condition or is rendered conductive by the failure of another component of the flame detecting means, this malfunction is detected by a testing circuit connecting SCR 62 across the conductors 42 and 44 through the circuit breaker 52, the conductors 70 and 154, the normally closed switch 86 of flame relay 58, and the conductors 160 and 45. Since the full operating voltage is applied across SCR 62 by this test circuit, a shorted or conductive condition of SCR 62 results in a high current flow through the circuit breaker 52 which thereupon assumes an open circuit condition thereby deenergizing the ignition and control system. Normally, no current flows in this testing circuit since SCR 62 is non-conductive in the absence of a malfunction while this testing circuit is effective.

At the same time, the heater 74 of the time delay device 54 is tested for a shorted condition by another testing circuit connecting the heater 74 across the conductors 42 and 44 through the circuit breaker 52, the conductor 70, SCR 60, the conductor 44, the diode 148, the conductor 146, the normally closed switch 80 of flame relay 56, and the conductor 45. Since substantially the full operating voltage is applied across the heater 74 on alternate half cycles, a shorted condition of the heater 74 results in a high current flow through the circuit breaker 52 which thereupon assumes an open circuit condition thereby deenergizing the ignition and control system. It will also be apparent that a shorted condition of the heater 74 prevents energization of the coil 76 of the flame relay 56.

When the non-conductive state of SCR 62 and the non-shorted condition of the heater 74 have been verified by their respective testing circuits, the energization of the coil 76 of flame relay 56 through SCR 60 causes the flame 56 to switch from its non-operated state to its operated state. The resultant closing of the relay switch 78 establishes an energization circuit for the heater 74 and the coil 84 of flame relay 58 extending from the conductor 70 through SCR 60, the conductor 144, the diode 148, the heater 74, the conductor 146, the relay switch 78, the conductor 150, and the flame relay coil 84 to the conductor 45. This energization circuit also functions as a testing circuit to check the continuity of the heater 74. In the event that the heater 74 has an open-circuit condition preventing the energization of the flame relay coil 84, the flame relay 58 remains in its non-operated state with its open relay switch 90 preventing the energization of the valve operators 20 and 22. If the heater 74 has a continuate condition, the ignition control system is now ready for energization of the pilot valve operator 20 and the ignition means 26 upon closing the flame relay switch 90. At this point, every component necessary to cause deenergization of the valve operator 20 if ignition of the pilot flame does not occur or is not detected has been tested. If any such component had a defective condition, the ignition and control system would not have functioned to energize the pilot valve operator 20. Furthermore, with the exception of SCR 62, the failure of any of the tested components in an open circuit condition during the timed trial ignition period will cause the ignition and control system to revert to its initial condition and deenergize the valve operator.

While the invention has been described with reference to a specific preferred embodiment, it is to be understood that this description is made by way of example and not as a limitation to the scope of the invention.

What is claimed is:

1. A fail-safe, self-checking ignition and control system for a gas burning apparatus or the like that includes voltage supply means for supplying electrical energy from an electric power source for energization of said ignition and control system upon a need for operation of said gas burning apparatus, a main burner, a pilot burner, a gas supply for said burners, electrically operated ignition means operative when energized to ignite gas flowing from said pilot burner, a biased closed, electrically operated pilot valve in said gas supply and operative when energized to supply gas to said pilot burner for ignition by said ignition means to establish a pilot flame, and a biased closed, electrically operated main valve receiving its gas supply from said pilot valve and operative when energized to supply gas to said main burner for ignition by said pilot flame; said ignition and control system comprising:

first relay means including first actuating means, said first relay means having a first operational state when said first actuating means is deenergized and a second operational state when said first actuating means is energized;

second relay means including a second actuating means, said second relay means having a first operational state when said second actuating means is deenergized and a second operational state when said second actuating means is energized;

flame detecting means having first solid state switching means for controlling the energization of said first relay actuating means and second solid state switching means for controlling the energization of said second relay actuating means and including flame sensing means coupled to said two solid state switching means for rendering said first solid state switching mens conductive in the absence of flame at said pilot burner and for rendering said second solid state switching means conductive in the presence of flame at said pilot burner;

first and second power terminals connected to said voltage supply means by means including a circuit breaker responsive to the current flowing between said terminals and opening to disrupt the current flow between said terminals when said current exceeds a predetermined value;

first circuit means including means controlled by said second relay means in said second state thereof for connecting said pilot valve and said ignition means to said voltage supply means to effect energization of said pilot valve and said ignition means whereby said pilot valve permits fuel to issue from said pilot burner and be ignited by said ignition means, said first circuit means also including means controlled by said first relay means in said first state thereof for connecting said main valve to said voltage supply means when said second relay means is in said second state thereof to effect energization of said main valve whereby said main valve permits fuel to issue from said main burner for ignition by said pilot flame, said first circuit means further including time delay means in controlling relation to said pilot valve and said main valve and having electrical means operable when energized for a predetermined time interval to cause said time delay means to deenergize said pilot valve and said main valve;

second circuit means operative in response to a need for operation of said gas burning apparatus to check the non-shorted condition of said time delay actuator means prior to opening of said pilot valve including means controlled by said first relay means in said first state thereof connecting said time delay actuator means in series with said first solid state switching means to said power terminals to cause a current flow effecting opening of said current breaker when said time delay actuator means has a shorted condition;

third circuit means operative in response to a need for operation of said gas burning apparatus to check the non-conductive state of said second solid state switching means prior to said opening of said pilot valve including means controlled by said second relay means in said first state thereof connecting said second solid state switching means to said power terminals to cause a current flow effecting opening of said circuit breaker when said second solid state switching means is in a conductive condition;

fourth circuit means operative in response to a need for operation of said gas burning apparatus to check the conductive state of said first solid state switching means prior to opening of said pilot valve and to energize said first relay actuating means including means connecting said first solid state switching means and said first relay actuating means in series to said power terminals;

fifth circuit means operative in response to a need for operation of said gas burning apparatus to check the continuity of said time delay actuator means prior to opening of said pilot valve including means controlled by said first relay means in said second state thereof connecting said first solid state switching means, said time delay actuator means and said second relay actuating means in series to said power terminals to effect energization of said second relay actuating means when said time delay actuator means has a continuate condition and to thereafter maintain said time delay actuator means and said second relay actuating means energized while said first solid switching means remains in a conductive condition; and sixth circuit means for maintaining said second relay actuating means energized after establishment of said pilot flame including means controlled by said second relay means in said second state thereof connecting said second relay actuating means and said second solid state switching means in series to said power terminals.

2. A fail-safe, self-checking ignition and control system for a gas burning apparatus or the like that includes voltage supply means for supplying electrical energy from an electric power source for energization of said ignition and control system upon a need for operation of said gas burning apparatus, a main burner, a pilot burner, a gas supply for said burners, electrically operated ignition means operative when energized to ignite gas flowing from said pilot burner, a biased closed, electrically operated pilot valve in said gas supply and operative when energized to supply gas to said pilot burner for ignition by said ignition means to establish a pilot flame, and a biased closed, electrically operated main valve receiving its gas supply from said pilot valve and operative when energized to supply gas to said main burner for ignition by said pilot flame; said ignition and control system comprising:

a normally closed time delay switch having electrical actuator means operable when energized for a predetermined short time interval to open said time delay switch;

a first flame relay having first and second normally closed switches and a third normally open switch, said first flame relay including first actuating means operative when energized to open said first and second switches and to close said third switch;

a second flame relay having fourth and fifth normally open switches and a sixth normally closed switch, said second flame relay including second actuating means operative when energized to close said fourth and fifth switches and to open said sixth switch;

flame detecting means having first and second solid state switching means and having flame sensing means coupled to said two solid state switching means for rendering said first solid state switching means conductive in the absence of flame at said pilot burner and for rendering said second solid state switching means conductive in the presence of flame at said pilot burner.

first and second power terminals connected to said voltage supply means by means including a circuit breaker responsive to the current flowing between said terminals and opening to disrupt the current flow between said terminals when said current exceeds a predetermined value;

a first circuit connecting said time delay switch, said fourth normally open switch of said second flame relay and said pilot valve in series to said voltage supply means;

a second circuit connecting said first normally closed switch of said first flame relay and said main valve in series across said pilot valve;

a third circuit connecting said ignition means in parallel with said pilot valve;

a fourth circuit connected to said power terminals for checking the non-conductive state of said second solid state switching means prior to ignition of said pilot flame including in series said second solid state switching means and said sixth normally closed switch of said second flame relay, said fourth circuit when said second solid state switching means is in a conductive condition having a current flow therethrough effective to cause opening of said circuit breaker;

a fifth circuit connected to said power terminals for checking the conductive state of said first solid state switching means prior to ignition of said pilot flame including in series said first solid state switching means and said first actuating means of said first flame relay;

a sixth circuit connected in parallel with said first actuator means of said first flame relay for checking the non-shorted condition of said time delay relay actuator means prior to ignition of said pilot flame including in series said time delay switch actuator means and said second normally closed switch of said first flame relay, said sixth circuit when said time delay actuator means is in a shorted condition preventing energization of said first actuating means of said first flame relay and having a current flow therethrough effective to cause opening of said circuit breaker;

a seventh circuit connected in parallel with said first actuating means of said first flame relay for checking the continuity of said time delay actuator means prior to ignition of said pilot flame including in series said time delay actuator means, said third normally open switch of said first flame relay and said second actuating means of said second flame relay, said seventh circuit when said time delay actuator means has an open condition preventing energization of said second actuating means, said seventh circuit when completed effecting energization of said time delay actuator means and said second actuating means while said first solid state means remain conductive; and an eighth circuit connected to said power terminals for maintaining said second actuating means of said second flame relay energized after ignition of said pilot flame including in series said second solid state switching means, said fifth normally open switch of said second flame relay, and said second actuating means.

3. The ignition and control system of claim 2 wherein said flame detecting means includes first and second gate control networks operably connected respectively to said first and second solid state switching means to apply firing signals respectively to said first and second solid state switching means for triggering said two solid state switching means into conduction, said first gate control network including a first field effect transistor operative when non-conductive to block firing signals from said first solid state switching means and prevent triggering of said first solid state switching means, said second gate control network including a second field effect transistor operative when conductive to shunt firing signals from said second solid state switching means and prevent triggering of said second solid state switching means, said flame detecting means further including input circuit means operably connecting the respective gates of said transistors to said flame sensing means for rendering said transistors conductive in the absence of flame at said pilot burner and for rendering said transistors non-conductive in the presence of flame at said pilot burner.

4. The ignition and control system of claim 3 wherein said flame sensing means comprises an electrode positioned to be enveloped in the flame at said pilot burner for completing an electric circuit through said flame to said input circuit means of said transistors.

5. The ignition and control system of claim 4 wherein said input circuit means includes a capacitor connected to the gates of said transistors and charged by rectified current flow through the flame at said pilot burner to effect a cut-off bias of said transistors.

* * * * *